United States Patent [19]

Barr

[11] 4,445,635

[45] May 1, 1984

[54] TWO WAY MAILING ENVELOPE

[76] Inventor: Arthur C. Barr, 1714 Yahara Pl., Madison, Wis. 53704

[21] Appl. No.: 379,658

[22] Filed: May 19, 1982

Related U.S. Application Data

[63] Continuation-in-part of Ser. No. 259,574, May 1, 1981, abandoned.

[51] Int. Cl.[3] ..... B65D 27/06
[52] U.S. Cl. ..... 229/73
[58] Field of Search ..... 229/73

[56] References Cited

U.S. PATENT DOCUMENTS

| | | | |
|---|---|---|---|
| 978,421 | 12/1910 | Wittmann | 229/73 |
| 1,025,837 | 5/1912 | Schnorr | 229/73 |
| 1,373,512 | 4/1921 | Kuhhorn | 229/73 |
| 2,012,075 | 8/1935 | Adams | 229/73 |
| 2,695,130 | 11/1954 | Covan | 229/73 |
| 2,931,559 | 4/1960 | Hilliard | 229/73 |
| 3,040,323 | 6/1962 | Brenner et al. | 229/68 R |
| 3,111,257 | 11/1963 | Peach | 229/73 |
| 3,558,040 | 1/1971 | Krueger | 229/73 |

FOREIGN PATENT DOCUMENTS

| | | | |
|---|---|---|---|
| 9635 | of 1900 | United Kingdom | 229/73 |
| 4857 | of 1903 | United Kingdom | 229/73 |

*Primary Examiner*—Stephen P. Garbe
*Attorney, Agent, or Firm*—Isaksen, Lathrop, Esch, Hart & Clark

[57] ABSTRACT

A business mail envelope is designed to enable it to be used as mail cover for both initial sending and for reply return using printed magnetic ink marking or optical character recognition markings, allowing use compatibly with manual sorting and electronic scanning sorting equipment. The original delivery address remains visible on the face of the envelope when received as return reply mail, but a second flap is used to cover the original postage and cancellation and to key a reader to read the return address rather than the original delivery address. The second flap, used during return mailing, may have a narrower portion coinciding with the position of the return address so that the return address remains exposed when the second flap is sealed to the front face of the envelope. Optical scanner readable key markings may be placed on the second flap to key the scanner to read the return address, and return address bar code information may be placed on the envelope to simplify reading by optical scanning equipment.

8 Claims, 6 Drawing Figures

TWO WAY MAILING ENVELOPE

This application is a continuation-in-part of copending application Ser. No. 259,574, filed May 1, 1981, now abandoned.

BACKGROUND OF THE INVENTION

A two way mail envelope may be constructed with an extra closure flap folded forward from the back panel of a mailing envelope for being withdrawn and used to reseal the envelope when it is used as cover for reply mail, and serving as well to cover and obliterate from view cancelled postage. Customarily, such an envelope has either been provided with a flap large enough to cover the initial delivery address appearing on the front face of the envelope or has had the initial delivery address printed on a peelable tab which is removed from the face of the envelope for re-use of the envelope as reply mail cover. Universally, past practice has been to obliterate or remove an initial mail address from the face of an envelope used for reply mail.

SUMMARY OF THE INVENTION

A two way mailing envelope which is self-addressed for reply mailing and which utilizes minimum paper stock is provided for use compatibly both with automated electronic scanning mail sorting equipment and with manual sorting. The original delivery address remains visible on the face of the envelope during reply mailing to facilitate sorting in the office of the original sender by identifying the originator of reply mail as being the person shown as the original addressee. The envelope flap size is of minimal dimensional reach from the top edge of the envelope, about one and one-quarter inches, and may either extend across the full face width of the envelope or only partially, having a narrower portion to expose a printed address marking in the upper left corner of the envelope as viewed. The flap may additionally be pre-printed with magnetic ink for machine reading, and, for identifying significance in visual sorting, is preferably color printed, as for example, in red. Magnetic ink marking so printed activates electronic scanning devices in mail sorting apparatus to read the address appearing in the same scanning level view as the marking and cancel further reading of the envelope at another location, namely, to read the upper left corner of the envelope as viewed for delivery address during reply mail transit and ignore the face center initial delivery address. The upper left corner address may be the return address which appears during initial mailing for envelopes in which the flap extends fully dimensioned only partially across the face of the envelope; otherwise, for envelopes with flaps extending fully across the face of the front panel, a separate address may appear on the flap together with preferably, both an arrow symbol and printed words directing attention of manual mail sorters to the upper left hand corner address.

The envelope may further be adapted for handling by automated optical character recognition (OCR) equipment. Under standards prescribed by the Post Office, such equipment reads the address in the main address block, in the center of the face of the envelope, and customarily prints a bar code on the envelope at an assigned position. The bar code encodes the main address in a form capable of being read by bar code readers that sort and distribute the mail. On the envelope of the present invention, a facing identification marking, such as a darkly inked block, is placed on the second flap at a position which is preferably adjacent to the return address when the second flap is sealed on to the front panel. The presence of this marking keys the bar code reader equipment to read the bar code in the return address position and ignore the bar code in right hand corner of the envelope. Alternatively, the bar code corresponding to the return address may be preprinted on the envelope outside of the area normally read by the OCR equipment. When the envelope is in its return configuration with the key marking exposed, the bar code reader is keyed to ignore the addresse's bar code in the usual position on the envelope and to read the preprinted return bar code. A blanking code marking may be provided adjacent the preprinted bar code to aid the bar code reader equipment in ignoring the preprinted code during the original mailing and in finding the preprinted code during the return mailing.

Further objects, features, and advantages will be apparent from the accompanying detailed description taken in conjunction with the accompanying drawings.

BEST MODE FOR CARRYING OUT THE INVENTION

Figure 1:
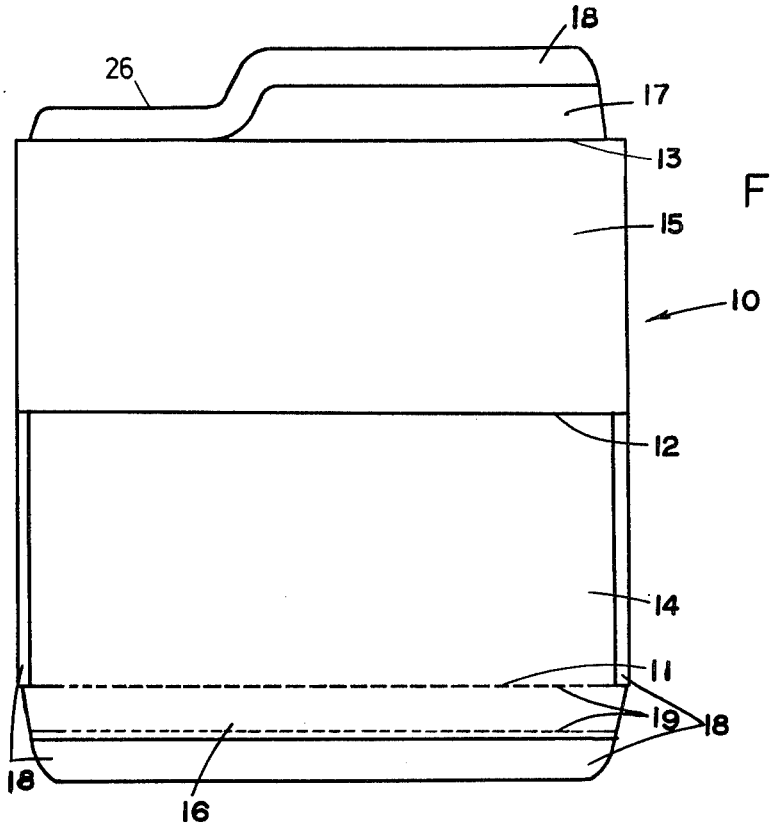
FIG. 1 is a plan view of a blank of one embodiment of an envelope of this invention.

Referring to the drawings, FIG. 1 shows a paper stock blank printed and gummed with sealing material for being assembled into an envelope of this invention. Blank 10 is but one of numerous configurations which may be employed to form the envelopes suitable for use in the manner described herein, there being numerous conventional patterns. Blank 10 is folded along fold lines 11, 12, and 13 so that the outer side of the front panel 14 comprises the front face of the folded envelope, the outer side of the rear panel 15 the rear face, and the flap 16, which extends from the fold line 11 at one edge of the front panel, the closure for use of the envelope as mail cover for initial mailing. Flap 17 extends from the fold line 13 at one edge of the rear panel 15 and is of slightly lesser length than the remainder of the blank, particularly the front panel 14 and rear panel 15. The flap 17 is folded during initial use of the envelope into a position of being tucked into the pocket formed by the envelope and disposed between panels 14 and 15. To form the blank into an envelope for mailing, the panels 14 and 15 are folded together about line 12, the second flap 17 is folded and disposed between panels 14 and 15, and the flap 16 is folded over panel 15 and sealed to the back exposed outer surface of the panel.

Because the flap 17 is not as long as the adjacent, unjoined edges of the front and back panels, it can be easily tucked between them even when the side edges of the panels are sealed together. Gummed strips 18 are provided either as self-sealing adhesive or as adhesive requiring moistening for forming an envelope by joining panels 14 and 15 into the body of the envelope and by sealing flaps 16 and 17 to the panels 15 and 14, respectively, for effecting a closure for the envelope during initial mailing and reply mailing, respectively.

The obverse face of flap 17, which is the reverse side of that shown in FIG. 1, has legend words "RETURN TO" and an arrow appearing as marking 20 printed in magnetic ink and preferably red in color. With the envelope folded and assembled, flap 17 will, for use in reply mailing, overlie a portion of the front face of the envelope with legend marking 20 being properly oriented for normal reading. The magnetic ink that may be used for printing marking 20 is that conventionally used in conjunction with electronic reading equipment such as blank check coding and dry goods label coding as well as mail sorting. Color coding of the ink, red for example, is desirable for alerting manual sorting personnel to recognize the reply mail delivery address as being that appearing in the upper left corner of the face of the envelope. A return address for initial mail delivery may be printed on the concealed face of panel 14 as viewed in FIG. 1 during manufacture of envelope blank 10; however, it is not necessary to provide such an address at this stage of envelope production and distribution, it being possible to have printed or to manually write a return address for initial delivery on the face of the envelope after it is assembled and sold in commerce. Parallel lines of serrations 19 provide a tear strip to facilitate opening the envelope upon initial delivery, since one line of serrations corresponds to the fold line 11, and serve to dispose of the initial closure flap 16 to render the envelope usable for reply mailing when the strip between the serrations 19 is pulled off.

Figure 2:
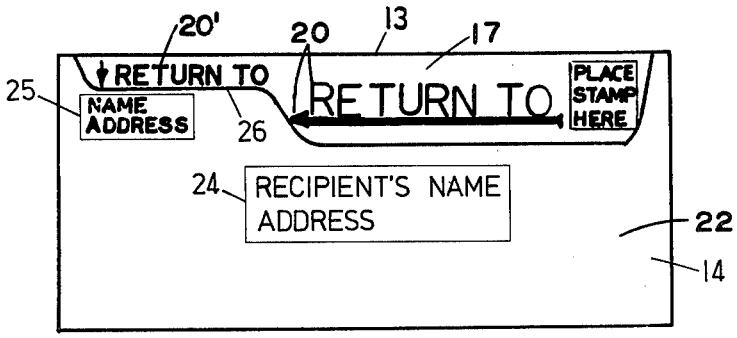
FIG. 2 is an elevation of the envelope of FIG. 1 in assembled arrangement for use in reply mailing.
Figure 3:
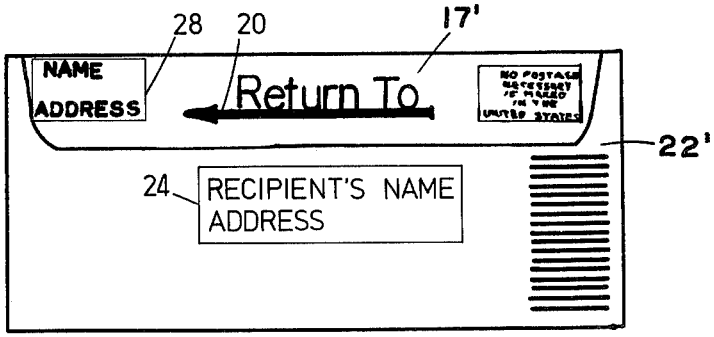
FIG. 3 is an elevation of another embodiment of an envelope of this invention assembled for reply mailing and bearing conventional business reply mail printing.

In FIG. 2 envelope 22 fabricated from blank 10 of FIG. 1 is shown with marking 20 visibly appearing on the front face of the envelope as sealed for use in reply mailing, and with the original recipient's name and address still showing at 24 on the face of the envelope. Marking 20 is disposed in the upper middle area of the face of panel 14 for triggering delivery address reading scanner, that is, in an area more than about three and one-half inches from the right side edge of envelope 22 as viewed, which demarks the area read by a postage reading scanner, and at an elevation at which the return address for initial mailing use of the envelope appears near the left side edge of envelope 22 as viewed. In the illustration of FIG. 2, the return address 25 for initial mailing also serves the purpose of denoting the delivery address for reply mailing; however, if the two addresses are not identical then an envelope configuration as shown in FIG. 3 would be employed. The cut-away configuration of flap 17, wherein the flap 17 includes a narrower portion 26 which does not cover the return address, enables a return address 25 to be printed in the upper left corner portion of panel 14 at anytime during manufacture, distribution and use; for large orders it may be desirable to have the return address printed during manufacture while for smaller orders made by small business or professional offices, for example, it may be preferred to have a local printer enter the return address. Any marking capable of actuating automated scanning equipment as well as alerting mail sorting personnel to read the upper left corner of the envelope for delivery address is sufficient for use as marking 20, but it is preferred to use red magnetic ink to print both an arrow as shown and wording to provide graphic and literal instruction to mail handlers in an obvious and compelling manner, as well as functioning to trigger an electronic reader to scan the envelope at that elevation on the face for delivery address including magnetic ink printed zip code. Words such as "Mail To", "Remail", "Reply Mail To" or other similar words may be used in place of those shown on the drawing. Placement of marking 20 at the upper middle face elevation serves to cancel further reading by scanning equipment of the retained initial delivery address 24 appearing face center below marking 20 thereby making it unnecessary to remove or obscure the latter retained address. It is to be understood, however, that for automated mail handling equipment in which datum reference for placement of postage and the like is not made to the top edge of the mail cover envelope and which does not necessarily advance past a scanner top edge first, that is, from the top of the envelope to the bottom as viewed in the drawings, that marking 20' printed in magnetic ink may optionally appear on flap 17 at the upper left corner of the face view of the envelope to insure that the delivery address and particularly the zip code identification therefor is read at that location and not elsewhere on the face of the envelope. During initial mailing use of the envelope, marking 20' will, of course, not be visible because flap 17 will be disposed within the sealed envelope.

In FIG. 3 another embodiment 22' of the invention is shown in which flap 17' extends substantially across the entire face of an envelope uniformly and provides space for entering an address 28 for reply mail delivery different from the return address appearing for use in initial mailing, which will be covered by the full width flap 17'. Optional marking 20' of FIG. 2 is not shown on flap 17' of FIG. 3 although it may be provided, if desired.

Figure 4:
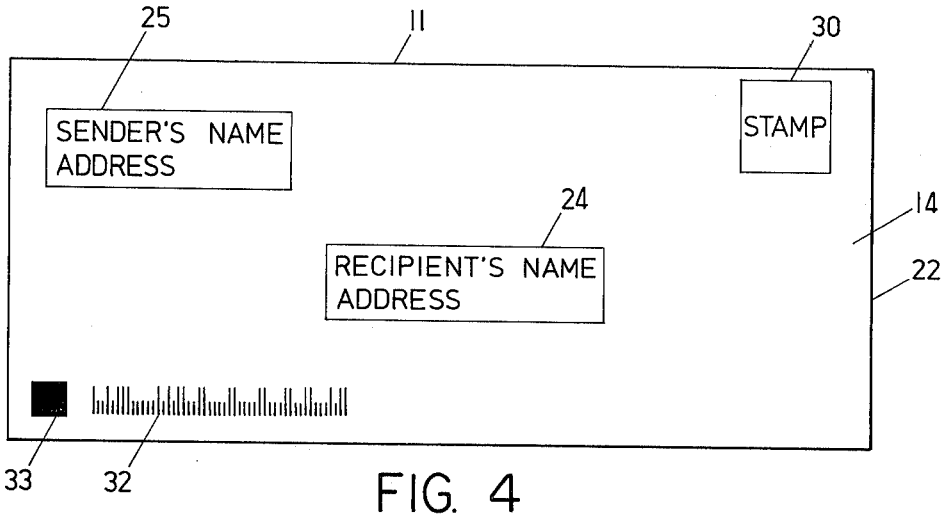
FIG. 4 is an elevational view of an envelope formed from the blank of FIG. 1 prepared for initial mailing and having a preprinted return bar code.

A front elevation view of the envelope 22 as sealed for initial mailing to the recipient is shown in FIG. 4. The original stamp 30 is normally positioned near the upper right hand corner, as customary. The envelope is opened by the recipient in the usual manner by cutting the top edge of the envelope along the line 11, thereby separating the front panel 14 from the first flap 16. Alternatively, where the serrations 19 are utilized forming parallel lines in flaps 16, the envelope may be opened by tearing off the strip defined between the serrated lines 19. In either event, the envelope is then opened at the top edge and the contents can be removed by the recipient. The second flap 17, which has been folded down and disposed between the front panel 14 and back panel 15 during initial mailing, is pulled out of the envelope by the recipient, who then places whatever material is required into the envelope before folding the second flap 17 downwardly over the front panel 14 and sealing the second flap 17 to the front panel by activating the adhesive 18 on the inner side of the flap 17.

In addition to the markings and indicia shown on the envelope 22 in FIG. 2, the envelope may also have a preprinted bar code 32 which encodes and corresponds to the sender's address 25. This bar code may be placed at the lower left hand corner of the front panel 14 of the envelope, since this area is generally not scanned by OCR equipment during the initial reading of the face of the envelope. See U.S. Postal Service regulations, as explained in Postal Service brochure entitled "Addressing for Optical Character Recognition." To further aid the OCR equipment to initially ignore the bar code 32, a blanking code marking 33, consisting of a heavy, darkly inked rectangle, may be marked adjacent to the bar code 32 so as to be instantly recognized by the OCR reader. Such a marking can serve to inform the reader that the trailing bar code 32 is to be ignored.

Figure 5:
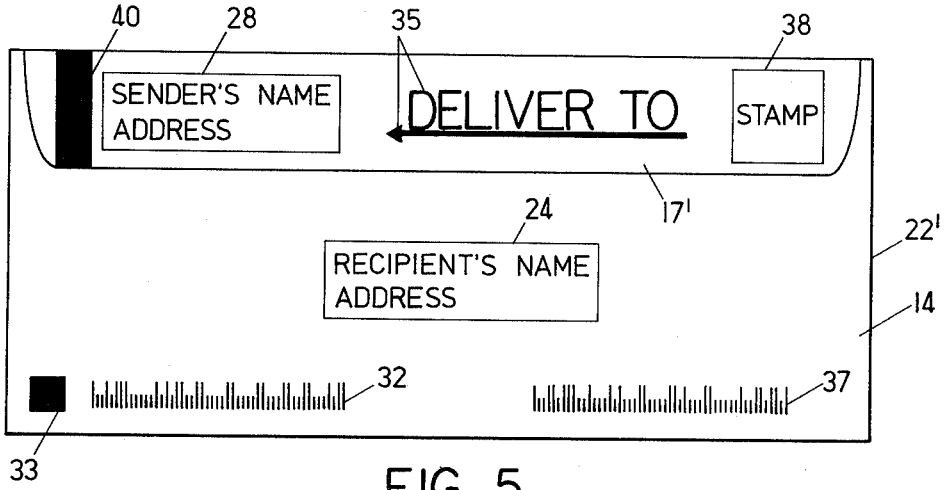
FIG. 5 is an elevational view of an envelope prepared for return mailing and formed from a blank similar to that of FIG. 1 but having a uniform width return flap.
Figure 6:
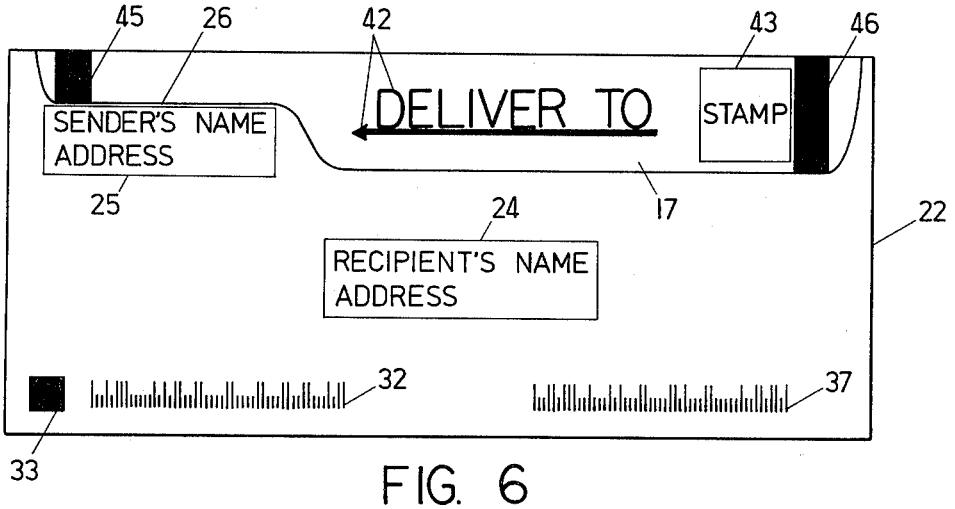
FIG. 6 is an elevational view of another envelope prepared for return mailing and formed from a blank similar to that of FIG. 1.

The views of FIGS. 5 and 6 show the envelope structures of FIGS. 3 and 2, respectively, utilizing somewhat different face markings but the same envelope structures. In the return envelope configuration of the envelope 22' shown in FIG. 5, the second flap 17' is folded over and sealed to the front panel 14. An alternative marking to advise Post Office personnel of the fact that the envelope is to be delivered to the return address is shown printed at 35. In addition, when the original envelope is initially processed through automatic OCR equipment which prints a bar code based on the recipient's address, the customary position of such bar code will be at the lower right hand corner of the envelope, as illustratively shown at 37 in FIG. 5. Since the flap 17' covers the original stamp 30, a new stamp 38 must be placed thereon in the customary upper right hand corner position. To trigger the bar code reader equipment to key to the sender's bar code at the lower left hand corner rather than the recipient's name and address 24 at the center of the envelope, a facing identification marking or key marking 40 is imprinted on the flap 17', preferably adjacent the sender's name and address 28. The key marking 40, as shown, is preferably a heavy, darkly inked area which is readily observed by the bar code reader equipment and which will cause it to key to the bar code 32 which is printed at the lower left hand corner. Alternatively, if no bar code 32 is preprinted, the OCR may be adapted to print the appropriate bar code at the position occupied by the bar code 32, or at another position on either the front or back of the envelope. The blanking code marking 33 can serve to direct the bar code reader equipment to the bar code 32 printed adjacent to it.

A modified envelope 22 having slightly different markings thereon is shown in FIG. 6, in which a "Deliver To" notation 42 is marked on the flap 17 at a position to direct Post Office personnel to look for the proper address at the position of the sender's name and address 25 rather than at the customary position 24 for the recipient's name and address. A new stamp 43 is also placed on the flap 17 in proper position towards the upper right hand corner of the envelope, since the flap 17 will cover the old, cancelled stamp. Key markings 45 and 46 are placed toward the side edges of the flap 17, and, as shown in FIG. 6, preferably consist of heavy, darkly inked rectangular areas that are easily visible to the bar code reader equipment and will immediately key such equipment to look for the appropriate address to be read either at the upper left hand corner position of the sender's name and address 25 or, if a bar code 32 has been preprinted, to examine the bar code 32 using the blanking identification marking 33. The presence of the blanking identification marking 33 instructs the OCR equipment that a bar code has already been preprinted and therefore to ignore the sender's name and address at the position 25. At least one of the key identification markings, such as the marking 45 shown in FIG. 6, is preferably formed adjacent to the sender's name and address 25.

It is understood that the invention is not confined to the particular construction and arrangement of parts herein illustrated and described, but embraces such modified forms thereof as come within the scope of the following claims.

I claim:

1. A two way postal envelope comprising:

(a) a front panel and a rear panel peripherally joined except along one edge of each panel, the unjoined edges of each panel being adjacent to one another;

(b) a first flap extending from the front panel along the one edge not joined to the rear panel, the first flap folded over and sealed to the rear panel;

(c) a second flap extending from the rear panel along the one edge not joined to the front panel, the second flap being folded over and disposed between the front and rear panels, the second flap having a portion thereof of uniform width that is narrower in width than the remainder of the flap and which is positioned at one end of the flap, the second flap having activatible adhesion on at least part of the side of the flap that faces the rear panel when the second flap is disposed between the front and rear panels, whereby, after the envelope has been opened by cutting along the intersection between the first flap and the front panel, the second flap may be pulled out of the envelope by a user and folded over and sealed to the front panel;

(d) return address markings on the outward side of the front panel in a return address position such that the markings will coincide with the position of the narrower portion of the second flap and will not be covered by the second flap when it is pulled out and sealed to the front panel, and wherein the wider portion of the second flap will cover the upper right hand portion of the face of the front panel wherein the original postage and cancellation markings are placed;

(e) an optical scanner readable blanking code marking and a return address bar code both imprinted in the lower left hand corner of the outward face of the front panel; and (f) an optical scanner readable key marking on the narrow portion of the second flap which will be exposed when the second flap is sealed ot the front panel whereby the key marking can be utilized ot key an optical scanner to read the return address in the return address block of the face of the front panel rather than the direct address or to a key a bar code reader to read the bar code in the lower left hand corner of the front panel.

2. The envelope of claim 1 wherein the second flap is shorter than the edges of the front and rear panels which are not joined to one another to allow the second flap to be folded over and tucked into the envelope between the front and rear panels without interference.

3. The envelope of claim 1 wherein the fold line by which the first flap is connected to the front panel is serrated to allow easy detachment along the fold line, and wherein the first flap further includes a line of serrations through the first flap that is parallel to the fold line by which the first flap is connected to the front panel, whereby when the first flap is sealed to the rear panel at a position outwardly of the strip defined between the two serrated lines in the first flap, the envelope may be opened by a user by tearing away the strip defined between the two serrated lines.

4. A two way postal envelope compatible for use with electronically automated equipment and with manual sorting, comprising:

(a) a front panel and a rear panel peripherally joined except along one edge of each panel with the unjoined edges of each panel being adjacent to one another;

(b) a first flap extending from the front panel along the one edge not joined to the rear panel, the first flap folded over and sealed to the outward face of the rear panel;

(c) a second flap extending from the rear panel along the one edge not joined to the front panel, the second flap being folded over and disposed between the front and rear panels, the second flap having activatible adhesive on at least part of the side of the flap that faces the rear panel when the second flap is disposed between the front and rear panels, whereby, after the envelope has been opened by cutting along the intersection between the first flap and the front panel, the second flap may be pulled out of the envelope by a user and folded over and sealed to the front panel;

(d) return address markings on the outward side of the second flap in a position such that the markings will be exposed when the second flap is pulled out and sealed to the front panel, and an optical scanner readable key marking on the second flap which is exposed when the second flap is pulled out and sealed to the front panel and which is capable of being read by an optical scanner to key the scanner to read the return address rather than the main address on the face of the front panel, and wherein the width of the second flap is selected such that the second flap, when folded out over the face of the front panel, will cover the position of the original postage and cancellation markings on the face of the front panel; and (e) an optical scanner readable blanking code marking and a return address bar code both imprinted in the lower left hand corner of the face of the front panel, whereby an optical scanner can be keyed by the key marking on the second flap and the blanking code marking on the face of the front panel to read the bar code address rather than the original direct address or the return address imprinted on the second flap.

5. The envelope of claim 4 wherein the second flap is shorter than the unjoined edges of the front panel and rear panel to allow the second flap to be folded over and tucked into the envelope between the front and rear panels without interference.

6. The blank of claim 4 wherein the fold line by which the first flap is connected to the front panel is serrated to allow easy detachment along the fold line, and wherein the first flap further includes a line of serrations through the first flap that is parallel to the fold line by which the first flap is connected to the front panel, whereby when the first flap is sealed to the rear panel at a position outwardly of the strip defined between the two serrated lines in the first flap, the envelope may be opened by a user by tearing away the strip defined between the two serrated lines.

7. A blank for a two way postal envelope comprising:

(a) a front panel having peripheral edges and a face and back side;

(b) a first flap connected to the front panel by a fold line along a peripheral edge of the front panel, the first flap having activatible adhesive on one surface thereof;

(c) a rear panel having peripheral edges and a face and back side and connected to the front panel by a fold line along a peripheral edge which is opposed to the peripheral edge at which the first flap is connected to the front panel;

(d) a second flap connected to the rear panel by a fold line along a peripheral edge of the rear panel which is opposed to the edge at which the rear panel is connected to the front panel, the second flap having a portion thereof of uniform width that is narrower than the remainder of the flap and positioned at one end of the flap, the second flap having activatible adhesive thereon on the side that is coplanar with the side of the first flap that has adhesive thereon;

(e) means for joining together the peripheral edges of the front and rear panels which are not connected by fold lines to another panel or to a flap, whereby the front and rear panels may be folded toward one another and sealed along all peripheral edges except the edges bearing the first and second flaps, and whereby the second flap may be disposed within the envelope between the front and rear panels and the first flap may be folded over the rear flap and sealed thereto to allow initial delivery of the letter, and whereby, upon opening of the letter by cutting along the fold line connection between the front panel and the first flap, the second flap may be pulled out of the envelope by a user, folded over the front panel and sealed thereto, with the narrower portion of the second flap positioned to expose a return address printed on the face of the front panel to allow the return address to be read either manually or by automated optical scanning equipment while the wider portion of the second flap covers the original postage and cancellation mark thereon;

(f) an optical scanner readable blanking code marking and a return address bar code both imprinted in the lower left hand corner of the face of the front panel; and (g) an optical scanner readable key marking on the narrow portion of the second flap.

8. The blank of claim 7 wherein the fold line by which the first flap is connected to the front panel is serrated to allow easy detachment along the fold line, and wherein the first flap further includes a line of serrations through the first flap that is parallel to the fold line by which the first flap is connected to the front panel, whereby when the first flap is sealed to the rear panel at a position outwardly of the strip defined between the two serrated lines in the first flap, the envelope may be opened by a user by tearing away the strip defined between the two serrated lines.

* * * * *

UNITED STATES PATENT AND TRADEMARK OFFICE

CERTIFICATE OF CORRECTION

PATENT NO. : 4,445,635

DATED : May 1, 1984

INVENTOR(S) : Arthur C. Barr

It is certified that error appears in the above-identified patent and that said Letters Patent are hereby corrected as shown below:

Column 3, line 21, "blank" should read --bank--.

Column 6, line 19, "adhesion" should read --adhesive--.

Column 6, line 43, "ot" should read --to--.

Column 6, line 44, "ot" should read --to--.

Signed and Sealed this

*Twenty-eighth* Day of *August 1984*

[SEAL]

*Attest:*

GERALD J. MOSSINGHOFF

*Attesting Officer*

*Commissioner of Patents and Trademarks*